United States Patent [19]

Bolton

[11] Patent Number: 4,509,277

[45] Date of Patent: Apr. 9, 1985

[54] COMBINATION BADGE AND CARD HOLDER

[75] Inventor: Edgar A. Bolton, Thousand Oaks, Calif.

[73] Assignee: Registration Control Systems, Ventura, Calif.

[21] Appl. No.: 463,124

[22] Filed: Feb. 2, 1983

[51] Int. Cl.[3] ..... A44C 3/00

[52] U.S. Cl. ..... 40/1.5; 40/10 D

[58] Field of Search ..... 40/1.5, 10 D, 1.6

[56] References Cited

U.S. PATENT DOCUMENTS

| | | | |
|---|---|---|---|
| 3,216,135 | 11/1965 | Wright | 40/1.5 |
| 3,295,235 | 1/1967 | Tauber | 40/1.5 |
| 3,355,826 | 12/1967 | Klein et al. | 40/1.5 |
| 3,371,829 | 3/1968 | Phillips | 224/5 |
| 3,657,834 | 4/1972 | Tauber | 40/1.5 |
| 3,939,588 | 2/1976 | Hockaday | 40/594 |
| 4,000,570 | 1/1977 | Carmen | 40/1.5 |
| 4,259,797 | 4/1981 | Belser | 40/1.5 |

*Primary Examiner*—Robert P. Swiatek
*Assistant Examiner*—Cary E. Stone
*Attorney, Agent, or Firm*—Nilsson, Robbins, Dalgarn, Berliner, Carson & Wurst

[57] ABSTRACT

A convention badge is provided having a combination of machine and visually readable cards, the machine-readable card being easily accessible for mechanically or electronically recording the information, and the visually readable cards containing information regarding the individual which is discernible at a substantial distance.

3 Claims, 3 Drawing Figures

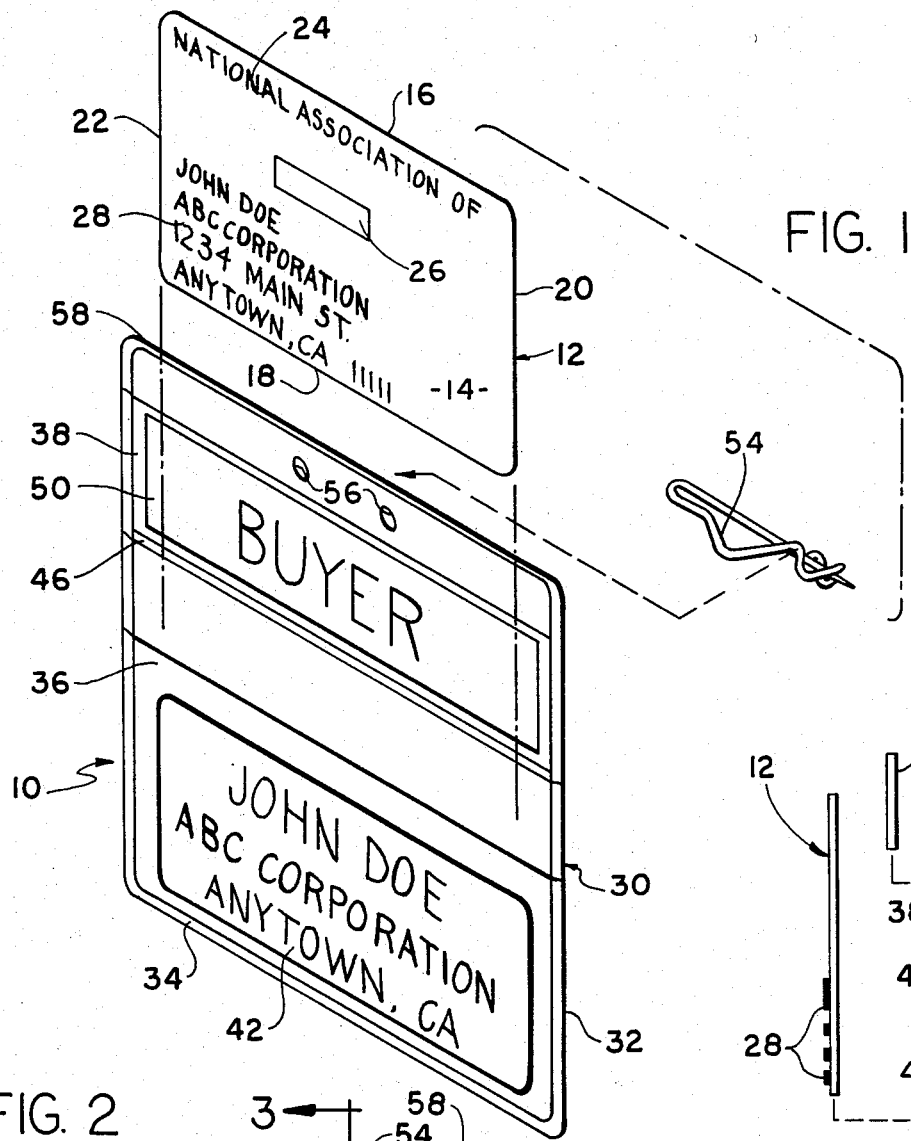
FIG. 1
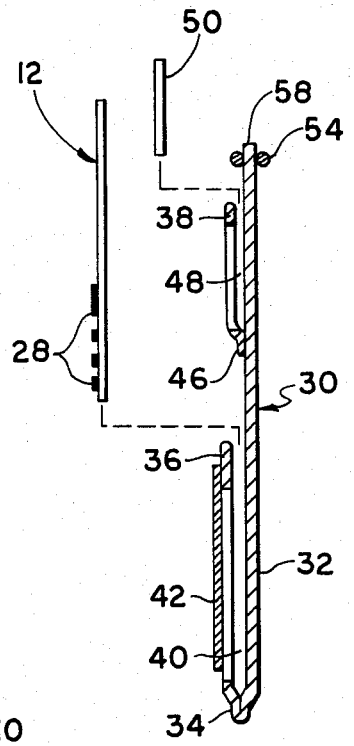
FIG. 3
FIG. 2
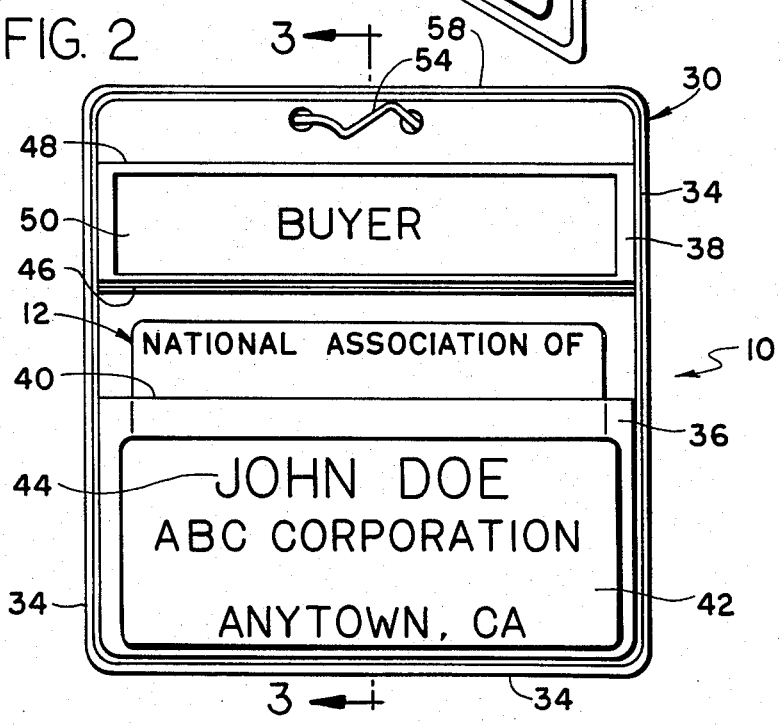

COMBINATION BADGE AND CARD HOLDER

FIELD OF THE INVENTION

This invention pertains to a badge for attendees at large gatherings, such as trade shows or conventions, wherein a machine-readable card insert is removably received therein.

BACKGROUND AND SUMMARY OF THE INVENTION

In many areas of endeavor, gatherings of large numbers of persons are very common. For example, associations of companies in many particular fields each year stage a convention or trade show of products sold by exhibiting member companies. Such a convention is an important marketing method for the participating firms. Attendance at such gatherings may total many thousands of persons, and the sponsors of the convention, as well as the participating firms, wish to have detailed information concerning the attendees. This may include the attendee name, company name and address and other information in easily recordable form so that further information regarding future conventions, new products or other information may be mailed to specific attendees. For example, while some information may be obtained about a product at an exhibitor's booth, it very often is necessary for an attendee to give his name to an exhibitor so that the requested information may be supplied to him at a later date. For this purpose, embossed plastic cards are produced, similar to the familiar credit card, which bear the attendee's name and address. When an inquiry is received, the exhibitor imprints a form with the inquiring attendee's card and thus reduces the time that each attendee must wait to record his inquiry.

Printing card holders are shown in U.S. Pat. Nos. 3,657,834 (Tauber, 1972) and 4,259,797 (Belser, 1981) which disclose a holder having a transparent exposed compartment adapted to receive a printing card/identity insert therein. These prior holders enable the removal of the rigid plastic card to enable the imprinting hereinbefore described, and the transparent pocket in which the card is received allows the attendee to be identified by a glance at the card displayed in the pocket which bears his name or affiliation.

While the described holders which retain machine-readable plastic cards offer certain advantages over the traditional visually-readable convention badges, there are substantial problems in their use. For example, imprinting machines have been standardized to accept a plastic card of about $3\frac{3}{8}$ by $2\frac{1}{8}$ inches and such cards are of insufficient size to contain all of the required information in visually readable form. For example, as an attendee approaches an exhibitor's booth, it is virtually impossible for an exhibitor to determine the attendee's name, company or status until the machine-readable card is removed from the holder. In this regard, in view of the large number of attendees at such meetings, it is often imperative that the exhibitor be able to identify an approaching individual so that prior contacts with the individual or the individual's employer may be recalled. Even if the printing card is provided with embossed information of sufficient size to be visually readable at a distance, there is insufficient space on the printing card to provide discernible information regarding the convention or sponsoring organization which enables convention officials to determine the individual's proper presence at the convention or in certain areas thereof. Moreover, information cards which contain data in electronically readable form, e.g. computer readable magnetic tape, provide even a smaller area for the display of visually-readable information.

Thus, it has been a desideratum in the convention badge art to provide a badge which facilitates the visual identification of admissible attendees by convention officials and the identification of an individual's name, company and status in visually-readable form, yet allows the recording of information by a machine-readable card.

In accordance with this invention, a convention badge is provided, the badge having a compartment formed of superimposed connected sheets of material which removably receives a card bearing machine-readable information regarding the individual, a second card or cards bearing visually-readable information regarding the individual, and means for retaining the badge on an article of apparel. The badge further includes a pocket, also formed of super-imposed connected sheets of material and an insert bearing machine-readable information regarding the individual's status, if required. In one aspect of the invention, the second card overlies and is adhesively attached to the compartment to present identifying information regarding the attendee which is visually-readable at a substantial distance.

The use of the badge in connection with the computer-controlled registration system described in U.S. Pat. No. 4,233,661 is particularly advantageous. In that patent, provision is made for a computer-controlled process which combines the registration procedure for large trade shows and production of the machine-readable information cards for convention attendees. Registration data is entered from terminal devices, and a programmed general purpose computer edits and formats the entered data and transfers the registration information to card embossers and printing devices which automatically produce both the machine-readable and visually-readable information cards under computer control. Thus, the production of both the machine-readable and visually-readable cards may be computer controlled.

According to the invention, attendees at a trade show or convention may be identified by providing the attendee with a badge as heretofore described, and the individual may be identified, for admission to a display hall or by the exhibitors, by the visually-discernible information on the badge. Specific information regarding the attendee may be retained by observing and manually recording the visually-observable information, or by removing the rigid card therefrom and retaining the machine-readable information by a recording means.

BRIEF DESCRIPTION OF THE DRAWINGS

FIG. 1 is a partially disassembled perspective view showing a badge according to the present invention;

FIG. 2 is a front elevational view thereof; and

FIG. 3 is a partially exploded sectional view on the line 3—3 of FIG. 2 in the direction of the arrows.

DESCRIPTION OF THE PREFERRED EMBODIMENT

Referring to the drawing in more detail, a badge according to the present invention is generally identified by the reference character 10. The badge 10 includes a machine-readable card 12, having a relatively rigid, flat body 14 having top and bottom edges 16 and 18, respectively, and side edges 20 and 22. Printed on the body 14, adjacent the top edge 16, is the name 24 of the sponsoring organization, and an ornamental design 26 therebelow. Since admission to trade shows or conventions is often restricted, such visually discernible indicia near the top 16 of the card 12 allows officials to quickly determine the individual's admissibility. Embossed on the card body 14 is machine-readable information 28, here seen to include the attendee's name, company and company address.

The badge 10 includes a holder 30 which is comprised of a first sheet of plastic material 32 which is connected, by the heat seal 34, to the transparent compartment and pocket-forming sheets 36 and 38 which are superimposed over the sheet 32.

The compartment 40, seen to be formed between the sheets 32 and 36, is seen to be sealed on three sides by the heat seal 34, and open along the top edge and adapted to receive the machine-readable card 12. The name 24 of the sponsoring organization near the top edge 16 of the card 12 is seen to project above the sheet 32 so that the attendee's admissibility may be readily determined as heretofore described.

An identification card 42 is seen to overlie the transparent sheet 36 which forms the outer aspect of the compartment 40. The card 42 is seen to include, in large type to facilitate identification at a substantial distance, indicia 44 regarding the name and company of the attendee.

The transparent sheet 38 is seen to be attached to the sheet 30 on either side by the heat seal 34, and at the bottom by the transverse heat seal 46, thereby forming a pocket 48 to receive the card 50. The card 50 may contain additional information regarding the attendee, for example, whether the individual is an exhibitor or manufacturer, or may designate a particular area of the convention to which the individual may be admitted. In this embodiment, the card 50 is seen to include indicia 52 which refers to the attendee's corporate function.

The badge 10 is seen to further include means for retaining the badge on an article of apparel, which in this embodiment comprise a pin 54 which is inserted into the apertures 56 as shown. In other embodiments, the retaining means may comprise an elongated extension of the sheet 32 which extends beyond the compartment 48 and is folded, along the line indicated by the top portion 58 of the badge 10, to lie behind the sheet 32, thus being adapted to be disposed in the breast pocket of the wearer, with the fold line being positioned on the pocket top edge.

Turning now to FIG. 2, which displays an aspect of the badge 10 which is presented to convention organizers and exhibitors, the badge 10 is seen to visually identify the wearer in a number of ways. First, the indicia 24, which is provided on the machine-readable card 12 and is visible above the information card 42, identifies the wearer's proper attendance at the particular gathering or a certain area thereof. Once the wearer has been admitted to the convention area, exhibitors may easily identify pertinent information regarding the wearer on the cards 42 and 50 due to the large and bold letters thereon. This enables an exhibitor to greet a prospective customer in a friendly way and easily identify those individuals whose company or status require selective contacts.

When information regarding the attendee is to be recorded, the exhibitor has the choice of manually recording the visually-readable information, or using the card 12 and retaining the machine-readable information by a recording means. Any one of a number of commercially available recording means may be employed, and the card 12 may be adapted to their use. For example, the lower portion of the card 12 may contain information in the form of computer-readable magnetic tape, which would allow the recording of detailed information regarding the attendee in machine-readable form, but provide no information which is visually observable.

Thus, the present invention is seen to provide a compact convention badge which includes an easily removable machine-readable information card which bears visually-discernible information regarding the convention, in combination with visually-observable information regarding the individual which is readable at a substantial distance. It is thought to be particularly advantageous to have the visually-readable information which identifies the attendee displayed other than on the rigid machine-readable card, not only because the information required for mailing may differ from that which facilitates identification of the individual and his or her status, but the reduced size of the machine-readable information enables the inclusion of visually-discernible indicia thereon to verify the proper presence at the convention.

Although the foregoing invention has been described in some detail by way of illustration and example, changes in form and the substitution of equivalents are contemplated as circumstances may suggest or render expedient; and although specific terms have been employed herein, they are intended in a descriptive sense and not for purposes of limitation, the scope of the invention being delineated in the following claims.

I claim:

1. A badge for an individual attending a convention, comprising:

a holder formed from a first plastic sheet, the holder having a compartment formed by a second plastic sheet superimposed and connected to the first sheet;

a first card removably and partially received in the compartment, said first card bearing machine-readable information regarding a mailing address of the individual on a bottom portion and visually-discernible information regarding the convention along an exposed upper portion thereof which extends above the second plastic sheet;

a second card bearing the name of the individual, the second card being adhesively attached to the second plastic sheet and overlying the portion of the first card bearing the machine-readable information;

a pocket formed from a third plastic sheet superimposed and connected to the first sheet, and an insert bearing visually-readable information regarding the individual's function at the convention inserted therein; and means for retaining the badge on an article of apparel wherein the compartment and the pocket are each visible while so retained on the article of apparel.

2. A method for identifying individuals attending a convention and retaining information regarding said individuals, the method comprising:

(a) providing said individuals with a badge comprising a holder having a compartment which removably and partially receives a first card, the first card bearing machine-readable information regarding a mailing address of the individual on a bottom portion and visually-discernible information regarding the convention on an exposed upper portion thereof;

a second card bearing visually-readable information regarding the individual and the individual's employment, the second card being adhesively attached to a first plastic sheet overlying the lower portion of the first card which bears the machine-readable information; and a pocket containing an inert bearing visually-discernible information regarding the individual's function at the convention, said compartment and pocket each being visible when the holder is attached to an article of apparel;

(b) identifying the individual by the information visually displayed on the badge; and (c) retaining information regarding the individual by removing the first card from the badge and recording the machine-readable information by a recording means, said removal being accomplished without releasing the badge from the article of apparel.

3. The method of claim 2 wherein the second visually-readable information on the second card includes the name of the individual and the individual's employer.

* * * * *